US011685584B1

(12) United States Patent
Chen et al.

(10) Patent No.: US 11,685,584 B1
(45) Date of Patent: Jun. 27, 2023

(54) HARDWARE MERCHANDISE CARRYING DEVICE

(71) Applicant: Shu-Hui Yeh, Changhua County (TW)

(72) Inventors: Chang-Xun Chen, Changhua County (TW); Yi-Ju Chen, Changhua County (TW)

(73) Assignee: Shu-Hui Yeh, Fuxing Township (TW)

( * ) Notice: Subject to any disclaimer, the term of this patent is extended or adjusted under 35 U.S.C. 154(b) by 0 days.

(21) Appl. No.: 17/563,116

(22) Filed: Dec. 28, 2021

(51) Int. Cl.
*B65D 85/28* (2006.01)
*B65D 73/00* (2006.01)
*A47F 5/00* (2006.01)

(52) U.S. Cl.
CPC ..... *B65D 73/0064* (2013.01); *A47F 5/0006* (2013.01)

(58) Field of Classification Search
CPC ..... B65D 73/0064; A47F 5/0006
USPC ..... 206/372, 376, 378, 379, 806; 211/70.6
See application file for complete search history.

(56) References Cited

U.S. PATENT DOCUMENTS 6,070,745 A * 6/2000 Dembicks ..... B25H 3/06 211/89.01
7,185,770 B1 * 3/2007 Roten ..... A47B 81/00 211/70.6
7,757,867 B2 * 7/2010 Hsieh ..... A47F 7/0028 211/70.6
7,802,680 B2 * 9/2010 Krebs ..... B25H 3/04 206/349
8,864,097 B2 * 10/2014 Wang ..... F16M 13/005 248/314
2003/0024837 A1 * 2/2003 Chen ..... B25H 3/003 206/378
2005/0126943 A1 * 6/2005 Liu ..... B65D 73/0064 206/349
2007/0034771 A1 * 2/2007 Liu ..... B65D 73/0064 248/682
2018/0361564 A1 * 12/2018 Hurley ..... B25H 3/04

* cited by examiner

*Primary Examiner* — Luan K Bui
(74) *Attorney, Agent, or Firm* — Hammer & Associates, P.C.

(57) ABSTRACT

A hardware merchandise carrying device is adapted to hold at least one hardware merchandise that has a positioning portion, and includes at least one holding seat that has a main seat body, two elastic arm members, and first and second connecting units. The elastic arm members are adapted to be removably coupled to the at least one hardware merchandise. Each elastic arm member extends from the main seat body, and has an engaging portion adapted to engage the positioning portion of the at least one hardware merchandise. The first and second connecting units are disposed on the main seat body. The second connecting unit is adapted for engaging the first connecting unit of another holding seat.

15 Claims, 13 Drawing Sheets

HARDWARE MERCHANDISE CARRYING DEVICE

FIELD

The disclosure relates to a carrying device, and more particularly to a carrying device for holding hardware merchandise.

BACKGROUND

Tool sockets 10 sold at retail are typically packaged in a hanging display so that the size and specifications of the tool sockets 10 being sold are prominently displayed when they are on store pegs. The display aids consumers in selecting the correctly sized tool socket 10. FIG. 1 illustrates a conventional hardware hang member 1 disclosed in Taiwanese Utility Model Patent No. 547284. The conventional hardware hang member 1 includes a display panel 11, and an elastic clip 12 connected to the bottom of the display panel 11. The elastic clip 12 has a reserved section 121 that is used to connect to the display panel 11, and an elastic portion 122 that is connected to the reserved section 121, that has two protrusions 123, and that is configured to engage with the tool socket 10, Specifically, the elastic portion 122 deforms elastically and fits into the tool socket 10 with the two protrusions 123 engaging with an inner wall groove 101 of the tool socket 10 so that the tool socket 10 will be held by the conventional hardware hang member 1. When the consumer selects a particular tool socket 10 they will cut the reserved section 121 of the elastic clip 12 of the conventional hardware hang member 1 with a pair of scissors to detach the tool socket 10 from the conventional hardware hang member 1. Unfortunately, after the conventional hardware hang member 1 is severed it becomes useless and must be discarded, which is a waste of resources and is bad for the environment. Additionally, once the conventional hardware hang member 1 is severed from the tool socket 10 the consumer will have a difficult time organizing the tool socket 10, since the tool socket 10 is now separated from the conventional hardware hang member 1 and may not be easily found.

SUMMARY

Therefore, an object of the disclosure is to provide a hardware merchandise carrying device that can alleviate at least one of the drawbacks of the prior art.

According to the disclosure, a hardware merchandise carrying device is adapted to hold thereon at least one hardware merchandise that has a positioning portion. The hardware merchandise carrying device includes at least one holding seat that has a main seat body, two elastic arm members, a first connecting unit, and a second connecting unit. The two elastic arm members are elastic, are spaced apart from each other, and are adapted to be removably coupled to the at least one hardware merchandise. Each elastic arm member extends in a first direction from the main seat body and has an engaging portion that is adapted to engage the positioning portion of the at least one hardware merchandise. The first connecting unit is disposed on the main seat body. The second connecting unit is disposed on the main seat body, is opposite to the first connecting unit in a second direction that is substantially perpendicular to the first direction, and is adapted for engaging the first connecting unit of another holding seat.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
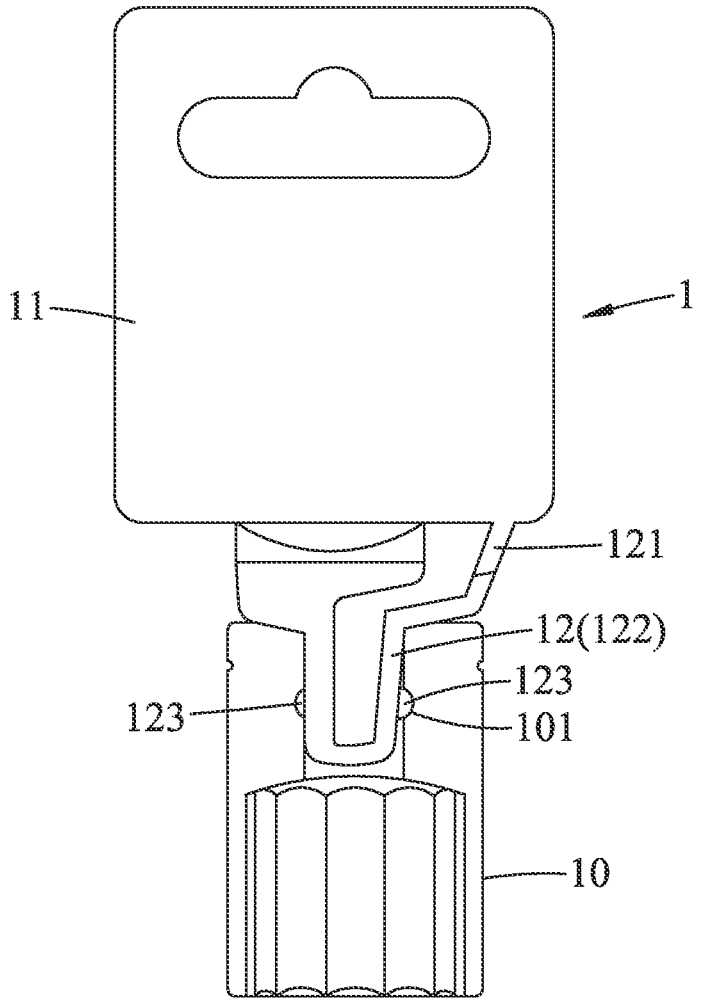
FIG.1 PRIOR ART
FIG. 1 is a front view of a conventional hardware hang member used to hold a tool socket disclosed in Taiwanese Utility Model Patent No. 547284.

Before the disclosure is described in greater detail, it should be noted that where considered appropriate, reference numerals or terminal portions of reference numerals have been repeated among the figures to indicate corresponding or analogous elements; which may optionally have similar characteristics.

Figure 2:
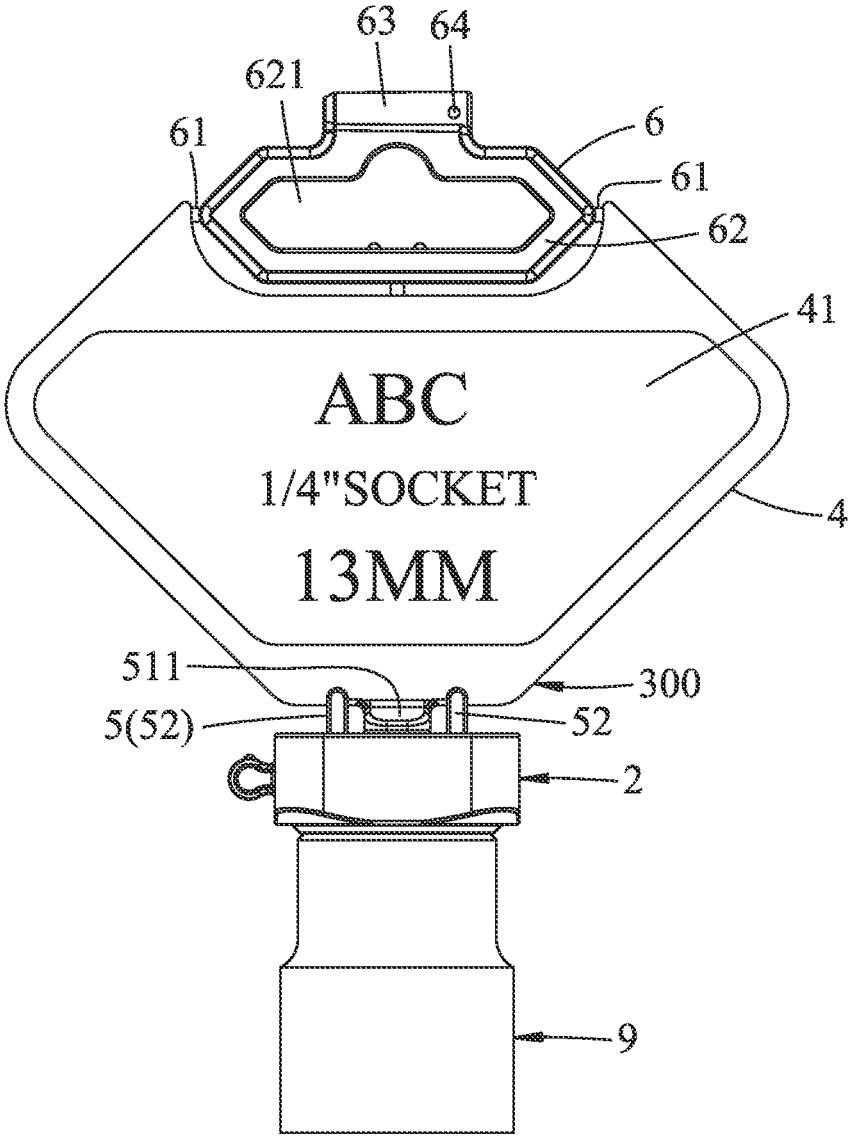
FIG. 2 is a front view illustrating a first embodiment of the hardware merchandise carrying device holding a tool socket.
Figure 3:
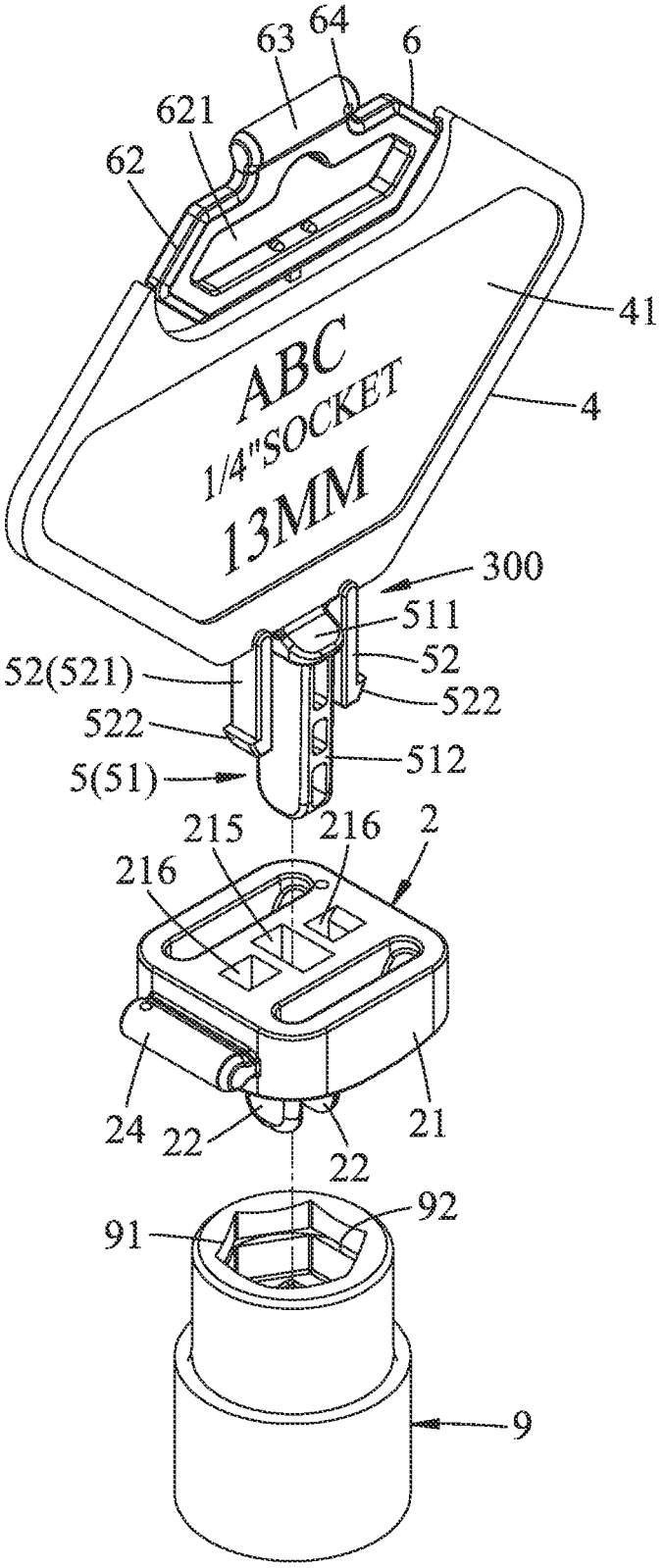
FIG. 3 is an exploded perspective view illustrating the first embodiment and the tool socket.

Referring to FIGS. 2 to 3, a first embodiment of a hardware merchandise carrying device is adapted to hold thereon at least one hardware merchandise 9. In the first embodiment there is one hardware merchandise 9, and it is exemplified as a tool socket; however, in other embodiments the hardware merchandise 9 can be a screwdriver head or other types of hardware tools. The hardware merchandise 9 defines a socket hole 91, and has a positioning portion 92. The positioning portion 92 is a ring-shaped groove surrounding and being in spatial communication with the socket hole 91. The hardware merchandise carrying device includes at least one holding seat 2 and a security unit 300; in the first embodiment the hardware merchandise carrying device includes one holding seat 2.

Figure 4:
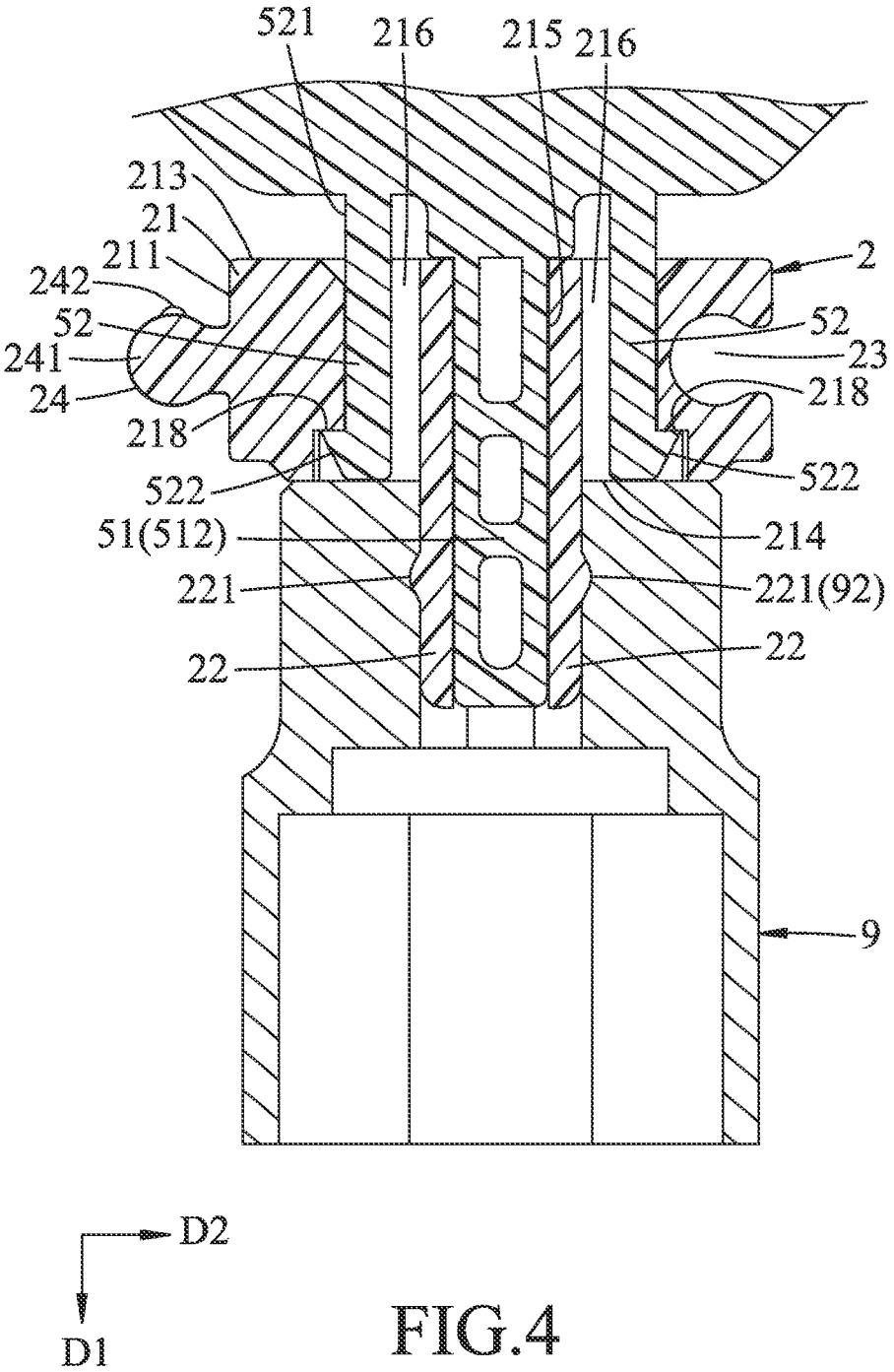
FIG. 4 is a fragmentary sectional view illustrating the first embodiment holding the tool socket.
Figure 5:
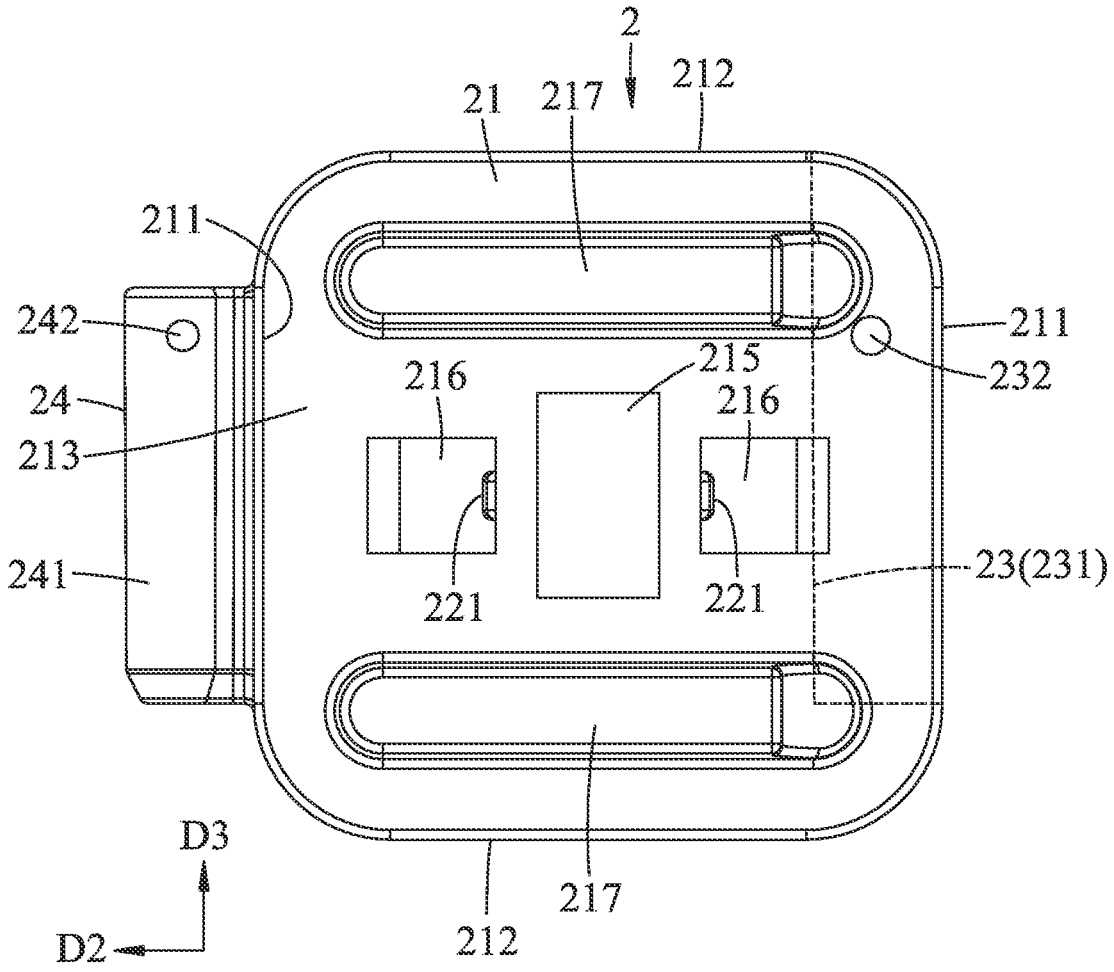
FIG. 5 is a top view of a holding seat of the first embodiment.
Figure 6:
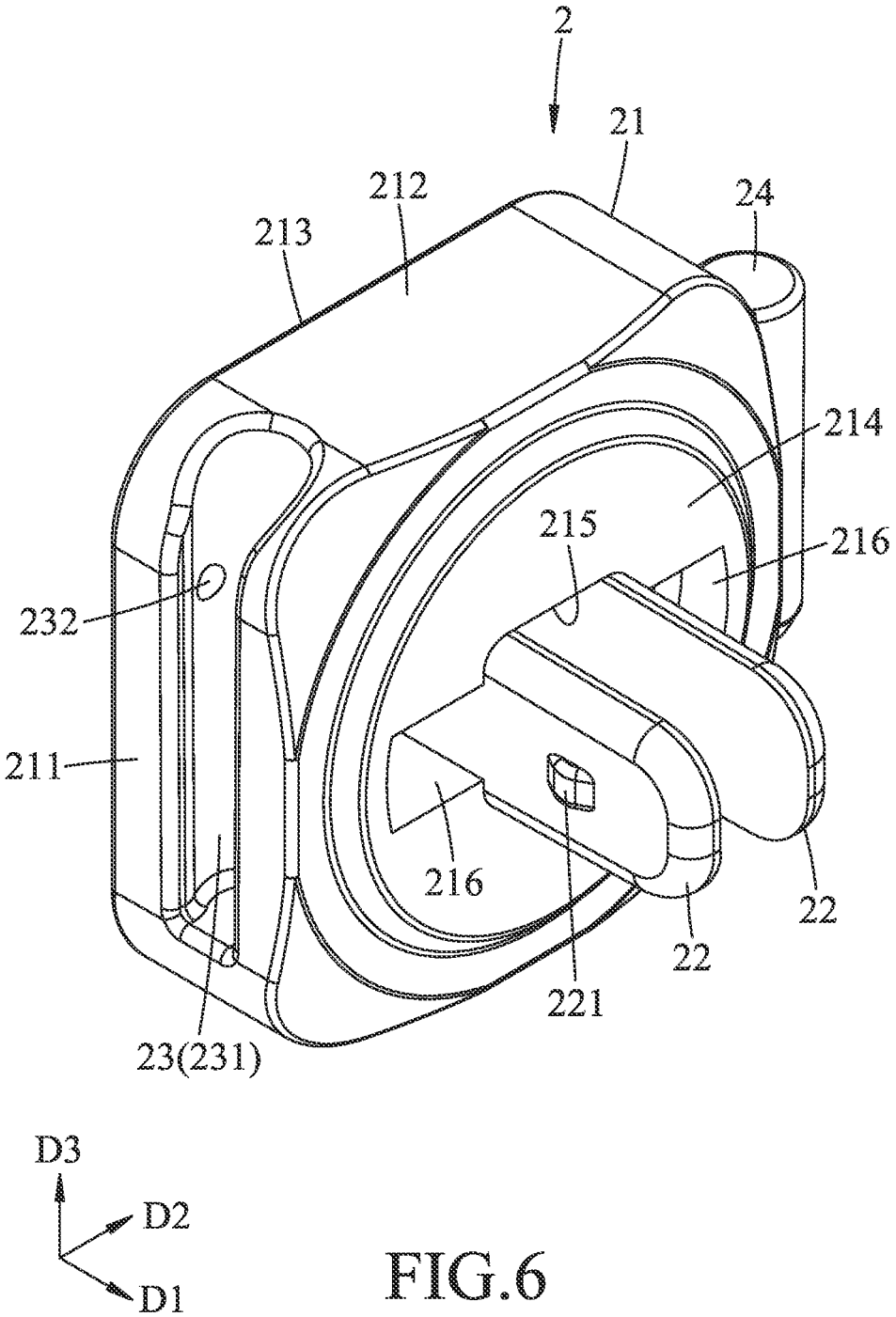
FIG. 6 is a perspective view showing the holding seat of the first embodiment.

Referring to FIGS. 4 to 6, the holding seat 2 is made of a plastic material, is adapted to removably couple with the hardware merchandise 9, and has a main seat body 21, two elastic arm members 22, a first connecting unit 23, and a second connecting unit 24. The main seat body 21 is substantially rectangular, and has two first lateral surfaces 211 that are spaced apart from each other, two second lateral surfaces 212 that are spaced apart from each other, a first end surface 213 that is connected to the first lateral surfaces 211 and the second lateral surfaces 212, and a second end surface 214 that is connected to the first lateral surfaces 211 and the second lateral surfaces 212 and that is opposite to the first end surface 213 in a first direction (D1). The main seat body 21 has a positioning hole 215 formed at the center of the main seat body 21 at least one locking hole 216, and two surface grooves 217 that are spaced apart from each other. Specifically, in the first embodiment, the main seat body 21 has two locking holes 216 spaced apart from the positioning hole 215. The positioning hole 215 is located substantially equidistant in between the two locking holes 216, and the locking holes 216 and the positioning hole 215 are substantially aligned in a second direction (D2) that is perpendicular to the first direction (D1), The two locking holes 216 and the positioning hole 215 extend in the first direction (D1) from the first end surface 213 to the second end surface 214 of the main seat body 21, and each of the two locking holes 216 has a keep portion 218, The two surface grooves 217 are located respectively at opposite sides of the positioning hole 215, and they are substantially aligned in a third direction (D3) that is perpendicular to the first and second directions (D1, D2).

The two elastic arm members 22 are adapted to be removably coupled to the hardware merchandise 9, are elastic, and are spaced apart from each other in the second direction (D2). The elastic arm members 22 can be moved closer to each other when subject to elastic deformation by an external force, and the positioning hole 215 is in spatial communication with a space between the two elastic arm members 22. Each of the elastic arm members 22 extends in a first direction (D1) from the second end surface 214 of the main seat body 21, and has an engaging portion 221 that is adapted to engage the positioning portion 92 of the hardware merchandise 9. In the first embodiment, the engaging portion 221 is a protrusion.

The first connecting unit 23 is disposed on the main seat body 21. The second connecting unit 24 is also disposed on the main seat body 21, and is opposite to the first connecting unit 23 in the second direction (D2). More specifically, the first connecting unit 23 is formed on one of the first lateral surfaces 211 and has a first connecting portion 231 and a first engaging portion 232 that is connected to the first connecting portion 231. The second connecting unit 24 is formed on the other first lateral surface 211, and has a second connecting portion 241 and a second engaging portion 242 that is connected to the second connecting portion 241. Referring to FIG. 6, in the first embodiment, the first connecting portion 231 is a groove that is elongated in the third direction (D3) and that has two opposite ends in the third direction (D3). One of the two opposite ends is an open end. The first engaging portion 232 is a recess formed in a groove-defining surface of the main seat body 21. The second connecting portion 241 is a column, and the second engaging portion 242 is a protrusion protruding from the second connecting portion 241, It should be understood that in other variations of this embodiment, the configurations of the first connecting portion 231 and the second connecting portion 241 may be interchanged, and the configurations of the first engaging portion 232 and the second engaging portion 242 may be interchanged. In other words, the first connecting portion 231 may be a column, and the first engaging portion 232 may be a protrusion; the second connecting portion 241 may be a groove, and the second engaging portion 242 may be a recess. In addition, it should be noted, that the first connecting unit 23 and the second connecting unit 24 may be respectively formed on the second lateral surfaces 212 instead of the first lateral surfaces 211.

Referring to FIGS. 2 to 4, the security unit 300 includes a display panel 4, a security module 5, and a hang tab member 6 configured for hanging. The display panel 4 is a thin board of a polygonal shape and has an information display area 41. The information display area 41 can be used to display the specification, size, type, make or trademark of the hardware merchandise 9 for consumer convenience. The display panel 4 has an end connected to the security module 5 and another end connected to the hang tab member 6. The security module 5 includes a prong member 51 and at least one latch member 52. In this embodiment, the security module 5 has two latch members 52, and the prong member 51 has a stop-block section 511 connected to the display panel 4, and a insertion section 512 extending from the stop-block section 511 in the first direction (D1). The prong member 51 is disposed between the two latch members 52, and each latch member 52 has a connecting section 521 connected with the display panel 4, and a hook section 522 connected to a distal end of the connecting section 521.

When the hardware merchandise carrying device is used to hold the hardware merchandise 9, the security unit 300 is first connected to the holding seat 2. The prong member 51 and the two latch members 52 of the security module 5 are respectively extended in the positioning hole 215 and the two locking holes 216 of the holding seat 2 until the two latch members 52 respectively engage with the keep portions 218 of the locking holes 216, and the stop-block section 511 of the prong member 51 abuts against the first surface 213 of the holding seat 2. At this stage, the security member 300 and the hold seat 2 are locked together, with the prong member 51 extending through the positioning hole 215, and the insertion section 512 of the prong member 52 extending into the space between the two arm members 22 and snuggly fitting between the elastic arm members 22. After the security member 300 is locked to the holding seat 2, the hardware merchandise 9 is connected to the hardware merchandise carrying device by extending the two elastic arm members 22 of the holding seat 2 into the socket hole 91 of the hardware merchandise 9 so that the engaging portion 221 of each arm member 22 engages the positioning portion 92 of the hardware merchandise 9. Consequently, the hardware merchandise 9 is securely held by the hardware merchandise carrying device which can prevent the theft of the hardware merchandise 9.

More specifically, the hardware merchandise carrying device can securely hold the hardware merchandise 9 because the elastic arm members 22 that were able to deform elastically have been made rigid by the prong member 51 snuggly fitting between the elastic arm members 22. Since the insertion section 512 of the prong member 52 will occupy the space between the elastic arm members 22, there will be no space left for the elastic arm members 22 to deform elastically. The prong member 51 can therefore effectively maintain engagement between the engaging portions 221 of the elastic arm members 22 and the positioning portion 92 of the hardware merchandise 9. Additionally, by virtue of the engagement between the two latch members 52 and the keep portions 218 of the locking holes 216, the latch members 52 are denied withdrawal from the locking holes 216 of the main seat body 21 in a direction opposite to the first direction (D1). This securely locks the security module 5 to the holding seat 2. The hardware merchandise carrying device is thus connected with the hardware merchandise 9 in a secure hold that cannot be easily released by the consumer, thereby deterring theft of the hardware merchandise 9.

In the first embodiment, the hang tab member 6 and the display panel 4 are connected by a plurality of integrally formed connection pins 61 that can be broken off to release the hang tab member 6 from the display panel 4. The hang tab member 6 has a main body 62 that is connected separately to the display panel 4 and that is configured for hanging, a connecting segment 63 that is connected to the main body 62, and an engaging segment 64. The main body 62 has a hang hole 621. In the first embodiment, the connecting segment 63 is a column, and the engaging segment 64 is a protrusion protruding from the connecting segment 63. The hang hole 621 can be used to hang the hardware merchandise carrying device holding the hardware merchandise 9 on a retail display (not shown).

Figure 7:
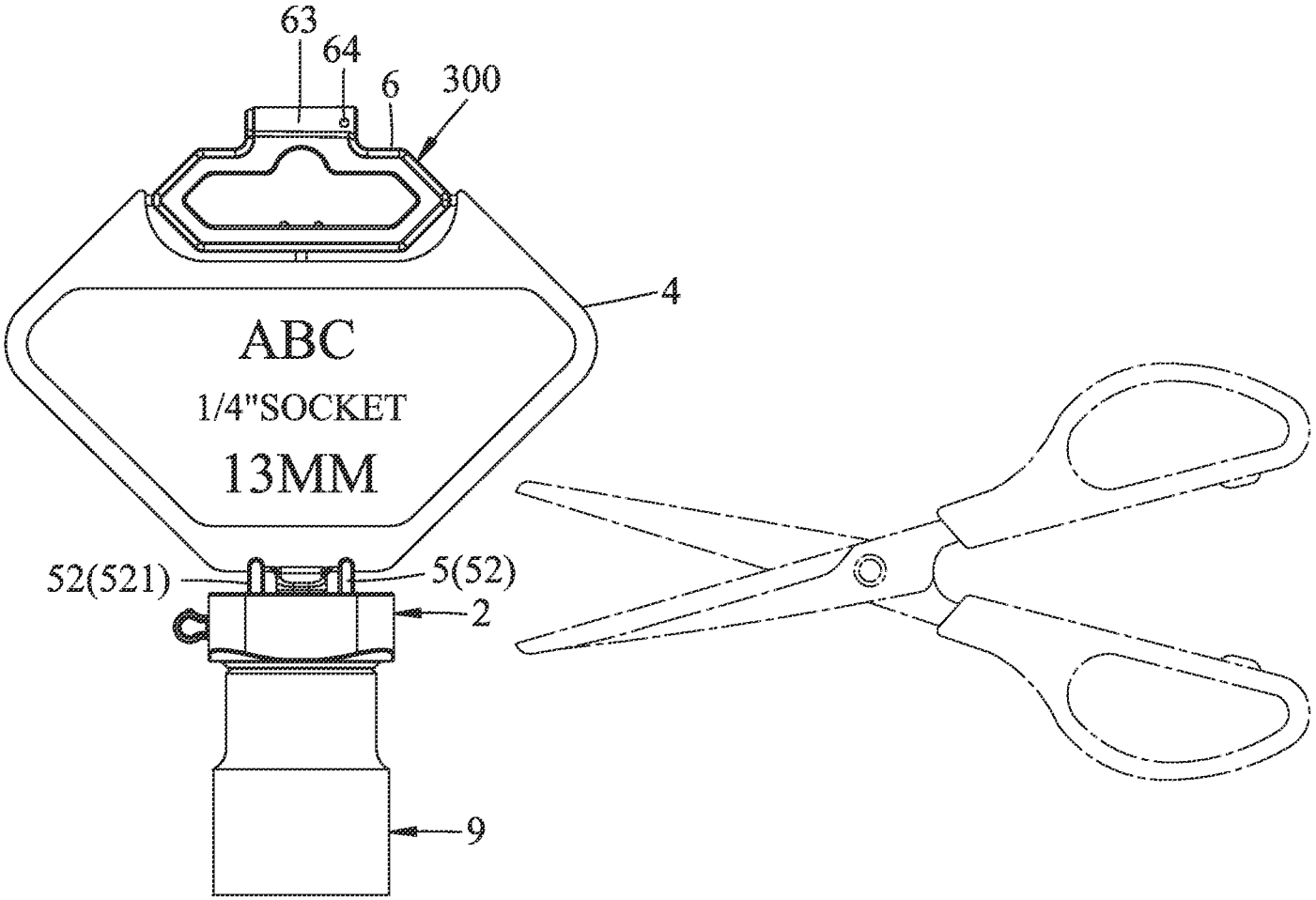
FIG. 7 is a schematic front view showing scissors being used to release the tool socket from the first embodiment.

Referring to FIG. 4 and FIG. 7, when the consumer wishes to release the hardware merchandise 9 from the hardware merchandise carrying device, the connecting sections 521 of the latch members 52 of the security module 5 are cut (e.g., with scissors) so that the security unit 300 may be released from the holding seat 2. After cutting the connecting sections 521 of the latch members 52, The prong member 51 of the security module 5 can then be removed from between the elastic arm members 22 to allow the elastic arm members 22 to be elastically deformed by the consumer, thereby disengaging the engaging portions 221 of the elastic arm members 22 from the positioning potion 92 of the hardware merchandise 9 and releasing the hardware merchandise 9 from the holding seat 2.

Figure 8:
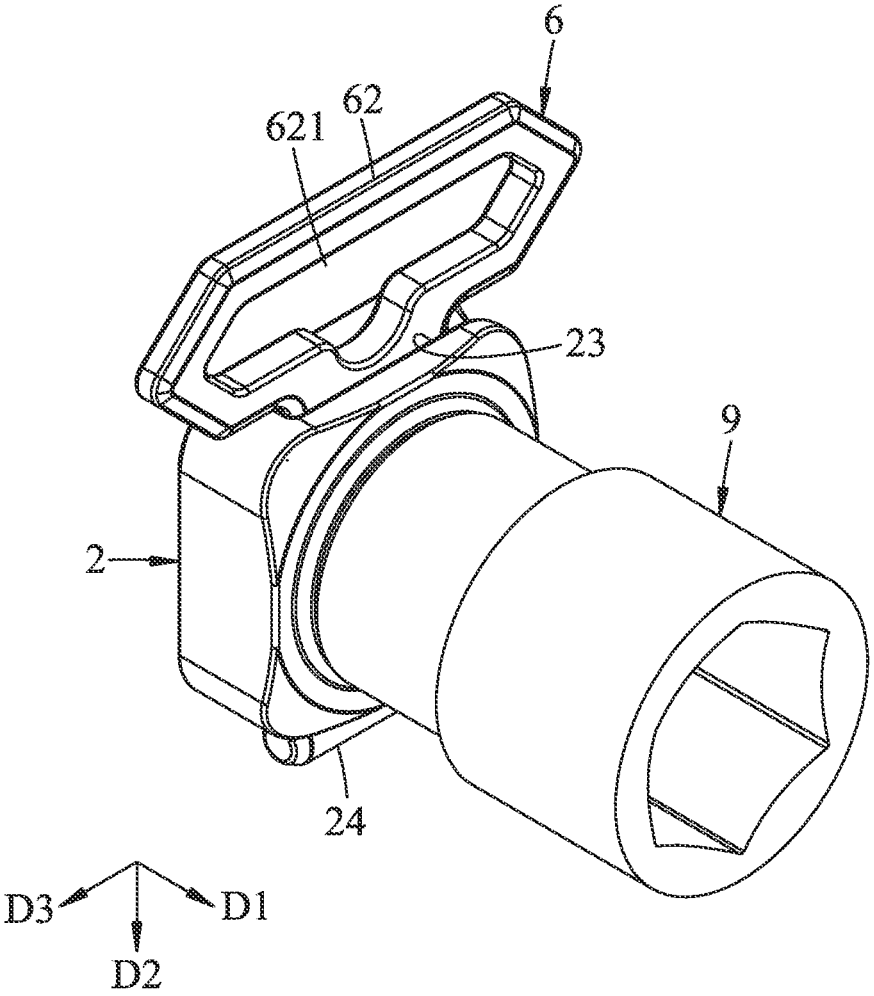
FIG. 8 is a schematic perspective view of the first embodiment illustrating a hang tab member holding the tool socket after the tool socket is released by the scissors from the first embodiment.

Referring to FIGS. 6 to 8, after purchasing the hardware merchandise 9 and releasing the hardware merchandise 9 from the holding seat 2, the consumer may break the hang tab member 6 off the display panel 4, so that the main body 62 of the hang tab member 6 is separated from the display panel 4. Then, the user can use the connecting segment 63 of the hang tab member 6 to engage the first connecting portion 231 of the first connecting unit 23 and the engaging segment 64 of the hang tab member 6 to engage with the first engaging portion 232 of the first connecting unit 23. When the consumer wishes to store the hardware merchandise 9 after purchase, the holding seat 2 may be re-connected with the hardware merchandise 9 via the elastic arm members 22, and the hang tab member 6 can be used to store the hardware merchandise 9 in a hanging configuration. The hardware merchandise carrying device in this disclosure makes the holding seat 2 and the hang tab member 6 functional after purchase, thereby reducing waste and having a lower environmental impact.

Figure 9:
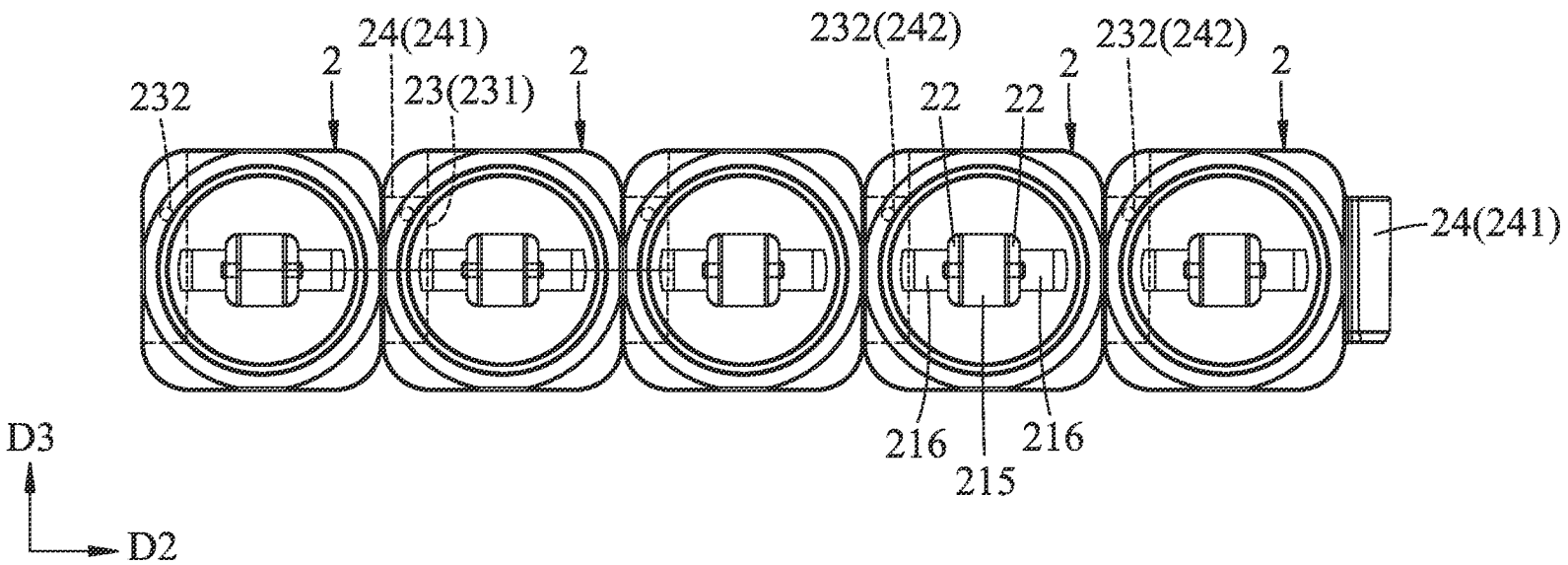
FIG. 9 is a bottom view illustrating a second embodiment including a plurality of hardware merchandise carrying devices removably connected.

Referring to FIG. 9, a second embodiment of the hardware merchandise carrying device according to this disclosure is shown. The second embodiment includes a plurality of the abovementioned holding seats 2 removably connected together in an assembly. It should be noted that the holding seats 2 are of the same size.

In this embodiment, for example, when there are two holding seats 2, the second connecting unit 24 of one of the holding seats 2 engages removably with the first connecting unit 23 of the other one of the holding seats 2. More specifically, the second connecting portion 241 of the second connecting unit 24 of one of the holding seats 2 engages the first connecting portion 231 of the first connecting unit 23 of the other one of the holding seat 2. In this way, when there are several holding seats 2, they may be removably connected in the second direction (D2). For each adjacent pair of the holding seats 2, the engagement between the second engaging portion 242 of one of the holding seats 2 and the first engaging portion 232 of the other one of the holding seats 2 prevents the holding seats 2 from misalignment and accidental separation. In this embodiment, the first connecting portion 231 of each holding seat 2 is a groove with only one end being an open end, and will have a restricting effect when engaged with the second connecting portion 241 of a corresponding holding seat 2, due to this structure.

Figure 10:
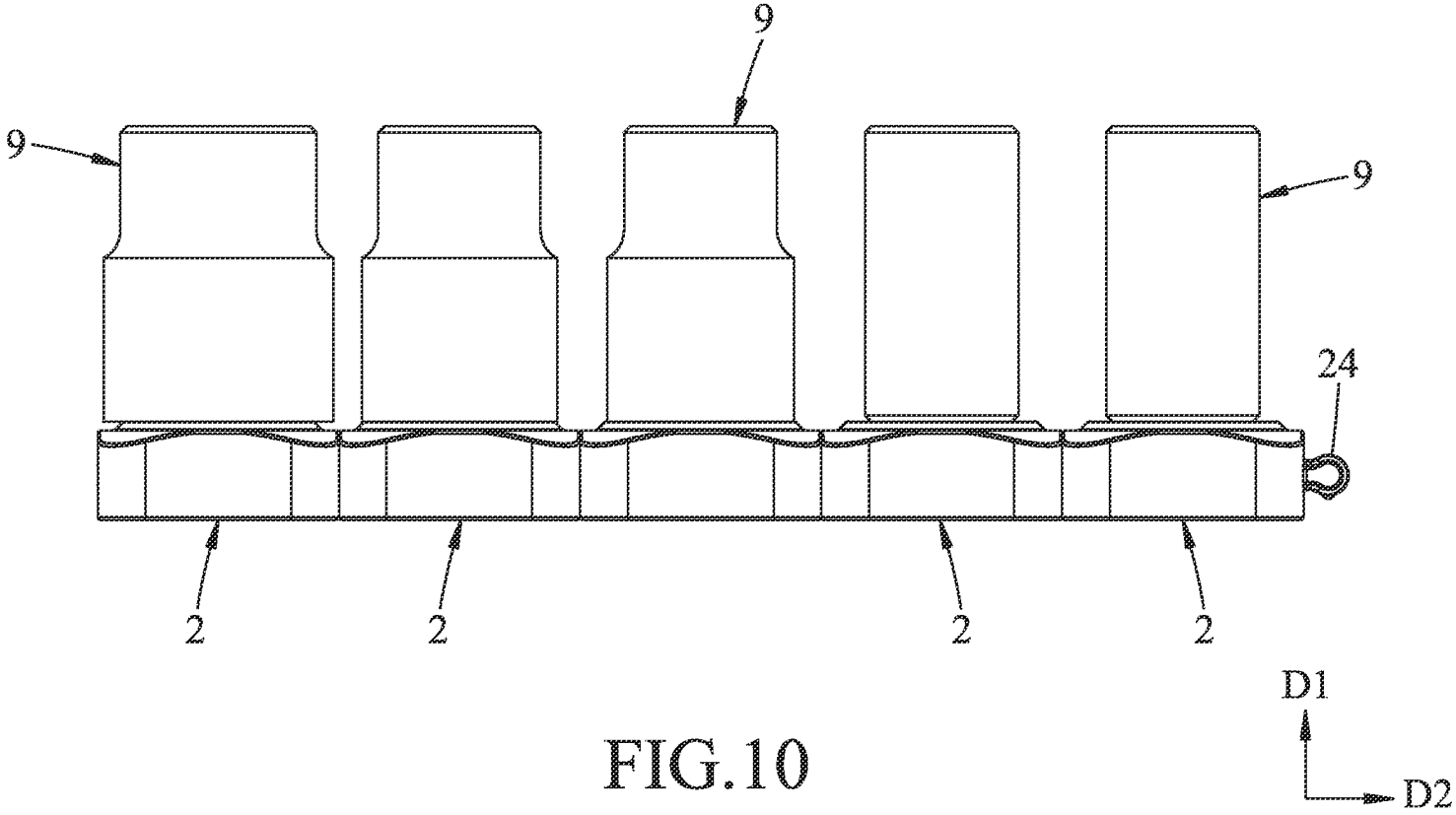
FIG. 10 is a side view of the second embodiment illustrating the second embodiment being used to hold different types of hardware.

Several different types of hardware merchandise 9 may be stored on the second embodiment of the hardware merchandise carrying device assembly. FIG. 10 shows such an assembly storing several different socket head tools which allows the consumer to organize purchased sockets and provides quick identification of the tools when the consumer needs to use them.

Figure 11:
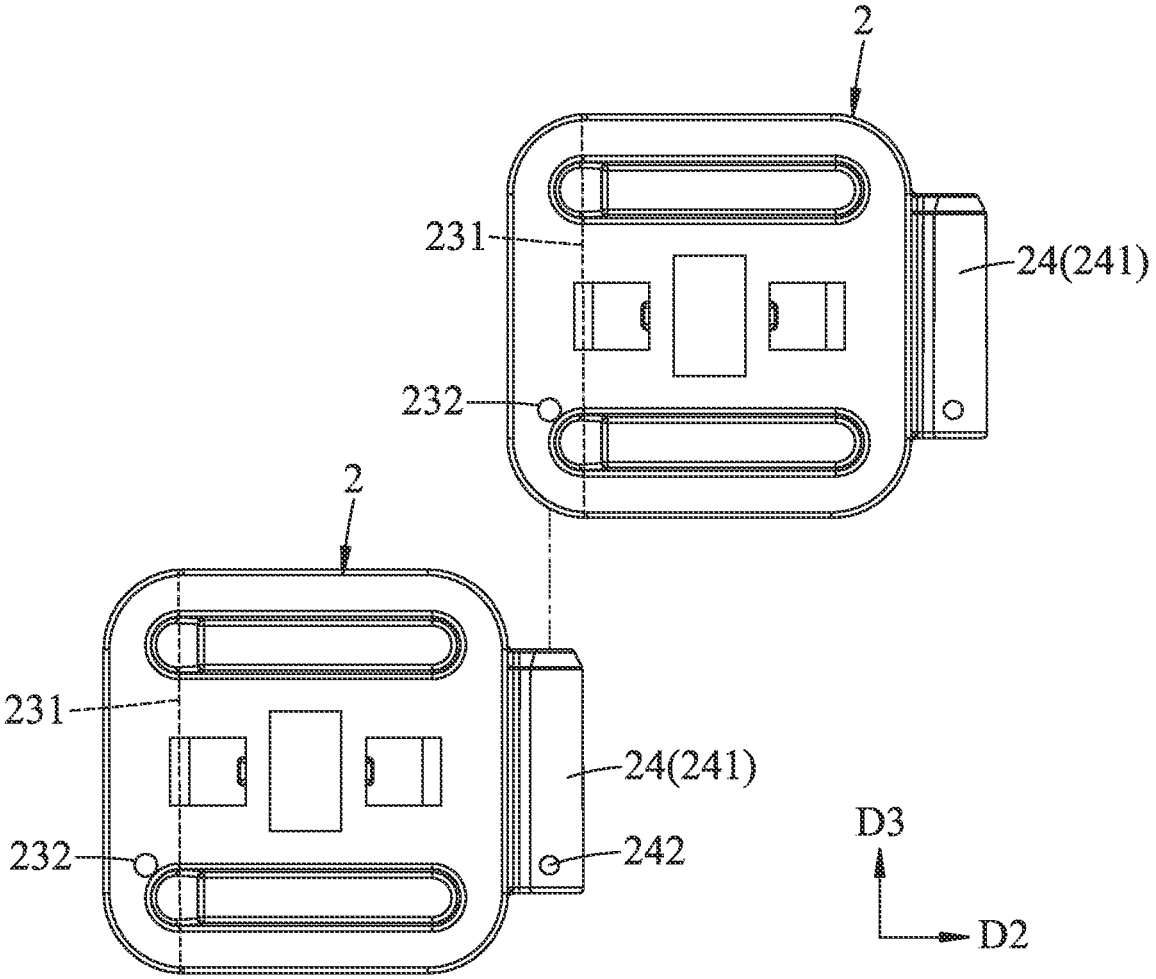
FIG. 11 is a schematic top view illustrating a method of engagement between two holding seats of the second embodiment.

Referring to FIG. 11, in other embodiments, the first connecting portion 231 of the first connecting unit 23 of each holding seat 2 has opposite ends that are open ends and in spatial communication with the external environment. With the double open-ended design of the first connecting portion 231 when each adjacent pair of the holding seats 2 are to be assembled, the second connecting portion 241 of one of the holding seats 2 can be engaged with the first connecting portion 231 of the other one of the holding seats 2 by sliding through either one of the open ends, which allows the engagement between the second connecting portion 241 and the first connecting portion 231 to happen in both directions, and is more convenient to operate.

Figure 12:
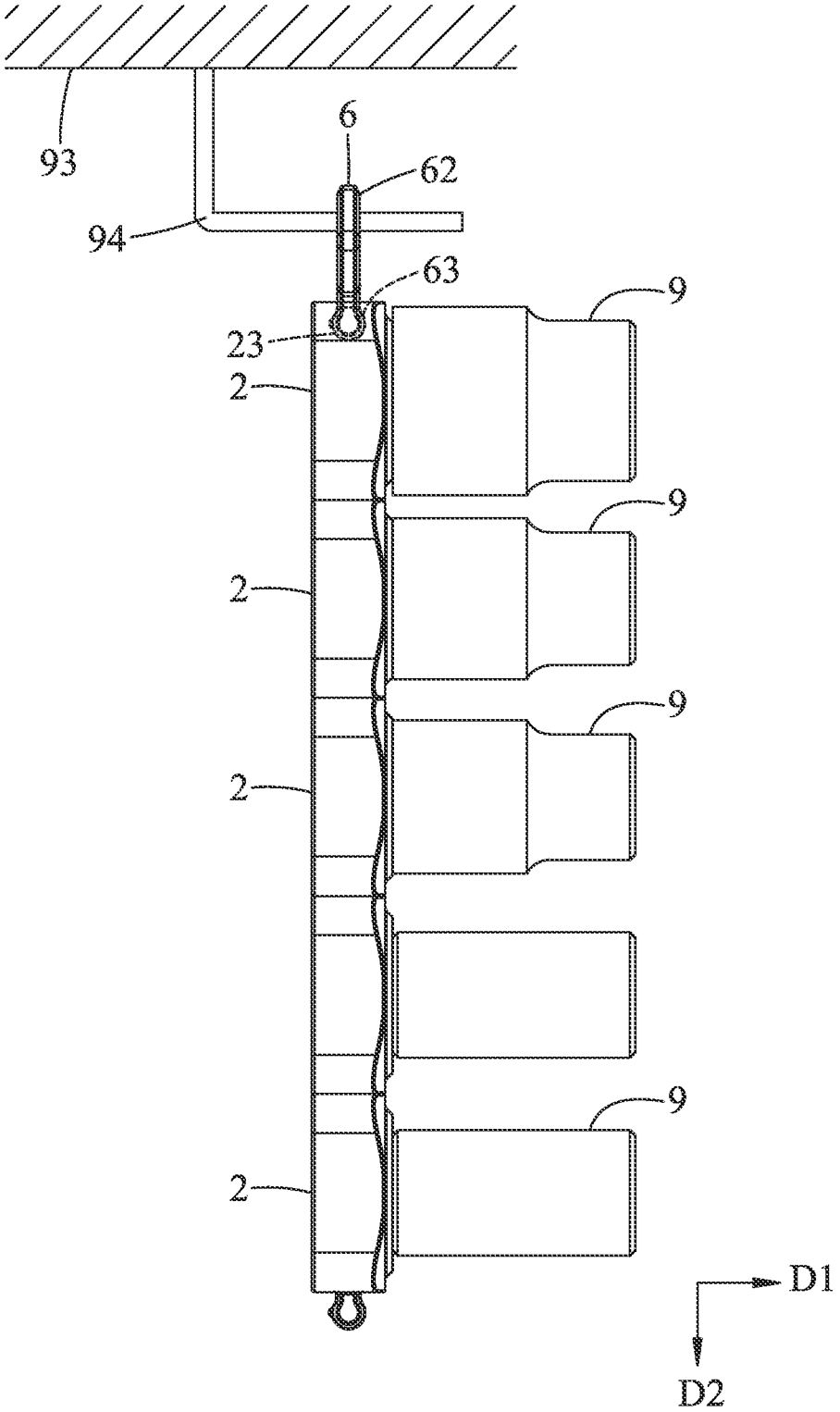
FIG. 12 is a partially sectional side view illustrating the second embodiment being used to hang the tool sockets.

Referring to FIG. 12, it should be further noted, that the consumer may elect to engage the connecting segment 63 of a separated hang tab member 6 onto the first connecting unit 23 of the first holding seat 2 in an assembly of holding seats 2. The main body 62 of the hang tab member 6 can be used to hang the interconnected holding seats 2 on a hanger 94 attached to a wall surface 93, which is a convenient storage method and may save storage space.

Figure 13:
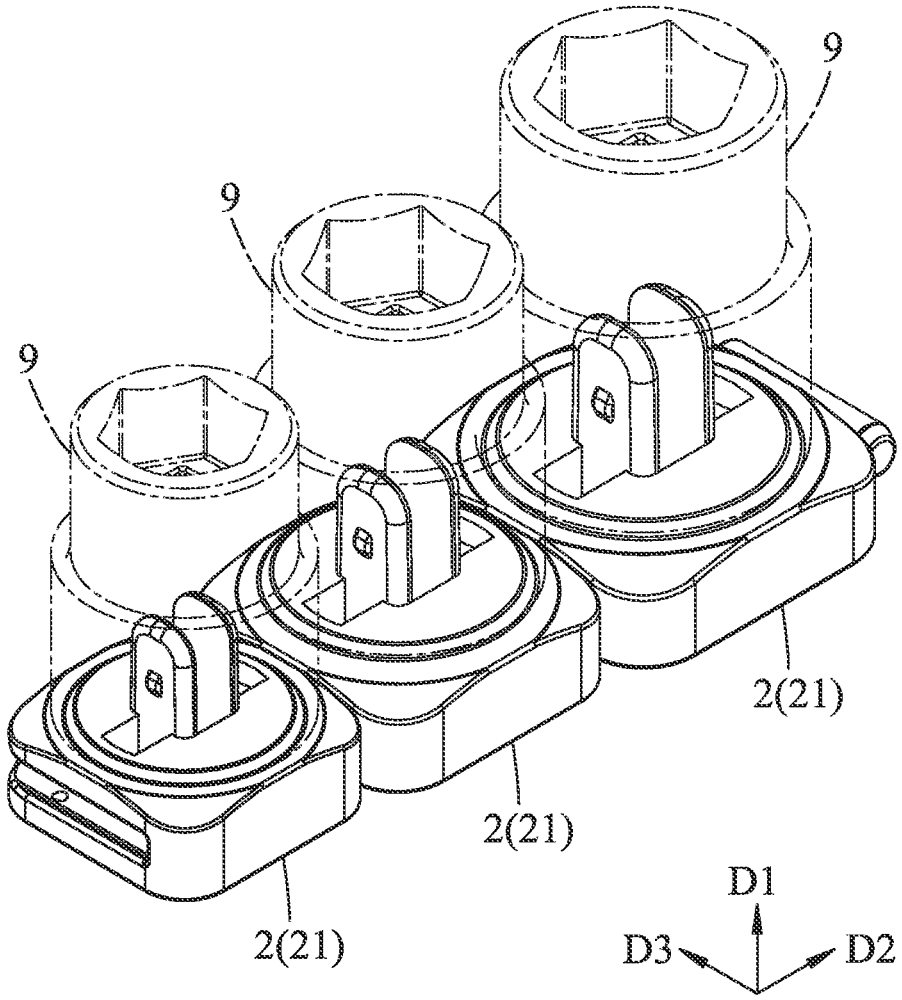
FIG. 13 is a schematic perspective view showing a variation of the second embodiment that includes holding seats of different sizes.

Referring to FIG. 13, a variation of the second embodiment is shown. In this variation, the main seat bodies 21 of the holding seats 2 are in different sizes. This variation allows main seat bodies 21 of different sizes to be interconnected, and thereby allows hardware merchandise 9 of different sizes to be efficiently stored.

In summary of the above, the hang tab member 6 and the holding seat 2 of the hardware merchandise carrying device are reusable after purchase, and therefore reduce waste and have lower environmental impact. Additionally, holding seats 2 of different sizes can be assembled together to hold hardware merchandise 9 of different sizes. The number of the holding seat 2 in an assembly may be enlarged or reduced according to spatial requirements, and may be hung from the hang member 6 for convenience.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A hardware merchandise carrying device adapted to hold thereon at least one hardware merchandise that has a positioning portion, said hardware merchandise carrying device comprising at least one holding seat having:

a main seat body;

two elastic arm members that are elastic, that are spaced apart from each other, and that are adapted to be removably coupled to the at least one hardware merchandise, each elastic arm member extending in a first direction from said main seat body and having an engaging portion that is adapted to engage the positioning portion of the at least one hardware merchandise;

a first connecting unit disposed on said main seat body; and a second connecting unit disposed on said main seat body, being opposite to said first connecting unit in a second direction that is substantially perpendicular to the first direction, and adapted for engaging said first connecting unit of another holding seat;

wherein said first connecting unit has a first connecting portion and a first engaging portion that is connected to said first connecting portion;

wherein said second connecting unit has a second connecting portion and a second engaging portion that is connected to said second connecting portion; and wherein said second connecting portion of said second connecting unit is adapted for engaging said first connecting portion of said first connecting unit of the another holding seat, and said second engaging portion of said second connecting unit is adapted for engaging said first engaging portion of said first connecting unit of the another holding seat.

2. The hardware merchandise carrying device as claimed in claim 1, wherein:

said at least one holding seat includes two holding seats; and said second connecting unit of one of said holding seats engages removably said first connecting unit of the other one of said holding seats.

3. The hardware merchandise carrying device as claimed in claim 1, wherein:

said first connecting portion is a groove, and said first engaging portion is a recess formed in a groove-defining surface of said main seat body that defines said first connecting portion; and said second connecting portion is a column, and said second engaging portion is a protrusion protruding from said second connecting portion.

4. The hardware merchandise carrying device as claimed in claim 3, wherein said first connecting portion has opposite ends that are open ends and in spatial communication with the external environment.

5. The hardware merchandise carrying device as claimed in claim 1, further comprising a hang tab member having:

a main body that is connected separately to said at least one holding seat, and that is configured for hanging; and a connecting segment that is connected to said main body, and that is configured to engage said first connecting unit of said at least one holding seat when said main body is separated from said at least one holding seat.

6. The hardware merchandise carrying device as claimed in claim 1, wherein:

said main seat body of said at least one holding seat has a positioning hole that extends in the first direction therethrough and that is in spatial communication with a space between said elastic arm members, and at least one locking hole that has a keep portion; and said hardware merchandise packaging device further comprises a security module that includes a prong member extending through said positioning hole of said main seat body, snuggly fitting between said elastic arm members, and adapted for maintaining engagement between said engaging portions of said elastic arm members and the positioning portion of the at least one hardware merchandise, and at least one latch member extending into said at least one locking hole, and engaging said keep portion of said locking hole such that said at least one latch member is denied withdrawal from said main seat body in a direction opposite to the first direction.

7. The hardware merchandise carrying device as claimed in claim 6, further comprising a security unit including said security member, said security unit further including a hang tab member that is configured for hanging.

8. The hardware merchandise carrying device as claimed in claim 7, wherein said security unit further includes a display panel that has an end connected to said security member and another end connected to said hang tab member.

9. The hardware merchandise carrying device as claimed in claim 8, wherein said hang tab member has:

a main body that is connected separately to said display panel and that is configured for hanging; and a connecting segment that is connected to said main body, and that is configured to engage said first connecting unit of said at least one holding seat when said main body is separated from said display panel.

10. A hardware merchandise carrying device adapted to hold thereon at least one hardware merchandise that has a positioning portion, said hardware merchandise carrying device comprising at least one holding seat having:

a main seat body;

two elastic arm members that are elastic, that are spaced apart from each other, and that are adapted to be removably coupled to the at least one hardware merchandise, each elastic arm member extending in a first direction from said main seat body and having an engaging portion that is adapted to engage the positioning portion of the at least one hardware merchandise;

a first connecting unit disposed on said main seat body; and a second connecting unit disposed on said main seat body, being opposite to said first connecting unit in a second direction that is substantially perpendicular to the first direction, and adapted for engaging said first connecting unit of another holding seat;

wherein said hardware merchandise carrying device further comprises a hang tab member having a main body that is connected separately to said at least one holding seat, and that is configured for hanging; and a connecting segment that is connected to said main body, and that is configured to engage said first connecting unit of said at least one holding seat when said main body is separated from said at least one holding seat.

11. The hardware merchandise carrying device as claimed in claim 10, wherein:

said at least one holding seat includes two holding seats; and said second connecting unit of one of said holding seats engages removably said first connecting unit of the other one of said holding seats.

12. The hardware merchandise carrying device as claimed in claim 10, wherein:

said main seat body of said at least one holding seat has a positioning hole that extends in the first direction therethrough and that is in spatial communication with a space between said elastic arm members, and at least one locking hole that has a keep portion; and said hardware merchandise packaging device further comprises a security module that includes a prong member extending through said positioning hole of said main seat body, snuggly fitting between said elastic arm members, and adapted for maintaining engagement between said engaging portions of said elastic arm members and the positioning portion of the at least one hardware merchandise, and at least one latch member extending into said at least one locking hole, and engaging said keep portion of said locking hole such that said at least one latch member is denied withdrawal from said main seat body in a direction opposite to the first direction.

13. The hardware merchandise carrying device as claimed in claim 12, further comprising a security unit including said security member, said security unit further including a hang tab member that is configured for hanging.

14. The hardware merchandise carrying device as claimed in claim 13, wherein said security unit further includes a display panel that has an end connected to said security member and another end connected to said hang tab member.

15. The hardware merchandise carrying device as claimed in claim 14, wherein said hang tab member has:

a main body that is connected separately to said display panel and that is configured for hanging; and a connecting segment that is connected to said main body, and that is configured to engage said first connecting unit of said at least one holding seat when said main body is separated from said display panel.

* * * * *